United States Patent [19]

Perry et al.

[11] 4,088,564

[45] May 9, 1978

[54] DEHYDRATING PROCESS FOR KETONE DEWAXING SOLVENTS

[75] Inventors: Stephen F. Perry, Westfield; Ralph R. Hall, Morristown, both of N.J.

[73] Assignee: Exxon Research & Engineering Co., Linden, N.J.

[21] Appl. No.: 752,134

[22] Filed: Dec. 20, 1976

[51] Int. Cl.[2] ..... C10G 43/14

[52] U.S. Cl. ..... 208/33; 208/31

[58] Field of Search ..... 208/31, 33, 321

[56] References Cited

U.S. PATENT DOCUMENTS

| | | | |
|---|---|---|---|
| 2,443,532 | 6/1948 | Berg | 208/31 |
| 2,734,849 | 2/1956 | Gross et al. | 208/31 |
| 2,738,306 | 3/1956 | Pratt et al. | 208/33 |
| 2,907,709 | 10/1959 | Benedict | 208/31 |
| 3,105,809 | 10/1963 | Butler et al. | 208/31 |

*Primary Examiner*—Herbert Levine

*Attorney, Agent, or Firm*—Edward M. Corcoran

[57] ABSTRACT

Ketone dewaxing solvent is separated and recovered from dewaxed oil and a wax slurry through the use of flash vaporization or distillation followed by steam stripping. Water is removed from the recovered solvent through the use of a combination of a decanting drum to form a solvent phase and a water phase, a deketonizer tower which strips solvent from the water phase, and a simple distillation tower which functions as a solvent dehydrator. It has been found that feeding a portion of the overhead vapors from the flash vaporization step directly to the bottom of the dehydrator provides enough heat to eliminate the need for a reboiler on the dehydrator tower.

16 Claims, 3 Drawing Figures

DEHYDRATING PROCESS FOR KETONE DEWAXING SOLVENTS

BACKGROUND OF THE INVENTION

1. Field of the Invention

This invention relates to an improved method of dehydrating ketone dewaxing solvent. More particularly, this invention relates to an improved method of dehydrating ketone dewaxing solvent wherein the improvement resides in eliminating a reboiler on the ketone dehydrating tower. Still more particularly, this invention relates to an improved method of dehydrating ketone dewaxing solvent recovered from dewaxed oil and a wax slurry via flash vaporization followed by steam stripping, whereby water is removed from the recovered solvent via the use of a decanting drum, a deketonizer tower, and a dehydration tower, the improvement comprising passing at least a portion of the hot overhead vapors from the wax flash vaporization directly to the bottom of the dehydrator thereby eliminating the need for a reboiler on the dehydrator.

2. Description of the Prior Art

The use of ketone solvents for dewaxing waxy petroleum oils is well known in the art. Solvents employed in ketone dewaxing processes are generally ketones containing from 3 to 6 carbon atoms such as acetone, methylethyl ketone, methylisobutyl ketone, etc., and mixtures thereof. The ketone solvents may also be admixed with aromatic solvents such as toluene, xylene, benzene, petroleum naphthas or mixtures thereof.

Solvent recovery is an integral part of any solvent dewaxing process, since the dewaxing solvent must be removed from both the dewaxed oil and wax and recycled back into the dewaxing operation. Most of the dewaxing solvent is removed from the oil and wax via flash evaporation, or simple distillation. However, small quantities of solvent remain in both the oil and wax even after distillation or flash evaporation. These small quantities of solvent are generally removed via a stripping operation wherein a gas such as nitrogen, a low molecular weight hydrocarbon or steam is passed through the wax and oil carrying with it any solvent that remained therein after distillation. Steam stripping is convenient and economical to use, but it introduces water into the solvent which must then be removed.

Typical of a ketone dewaxing and solvent recovery process which includes steam stripping and subsequent dehydration of the recovered solvent is that disclosed in U.S. Pat. No. 3,105,809. In this process, the bulk of the ketone dewaxing solvent is removed from both the dewaxed oil and wax slurry via distillation with the small quantities of solvent remaining after distillation removed from the oil and wax via steam stripping. The wet solvent overheads from the steam strippers are then condensed and passed to a decanting or solvent setting drum. In the decanting or solvent settling drum, the condensed liquid from the stripper overheads settles into a heavy, water-rich phase saturated with solvent and a light, solvent-rich phase which is saturated with water. The water-rich phase or liquid is drawn off from the bottom of the drum and steam distilled in a deketonizing tower. The steam removes the solvent from the water with the resulting solvent-free water then passed to a sewer and the solvent-containing overheads are returned to the solvent settling drum. The solvent-rich upper layer in the drum is fed as reflux to a simple distillation tower or solvent dehydrator provided with a reboiler. A portion of the condensed solvent from the oil and wax solvent recovery vaporization is also fed to the dehydrator. The overhead consisting of water and solvent is condensed and returned to the decanter drum while essentially water-free solvent is drawn off the bottom of the tower and recycled back to the dewaxing operation.

SUMMARY OF THE INVENTION

It has now been found that the reboiler on the solvent dehydrator can be eliminated in a ketone solvent recovery-dehydration process such as that shown in U.S. Pat. No. 3,015,809, if at least a portion of the hot solvent vapor overheads from the wax slurry distillation is passed directly to the base of the dehydrator tower instead of being condensed to liquid and then passed to the dehydrator tower as has heretofore been done, thereby operating the dehydrator tower without a reboiler. That is, the instant invention is an improved process for dehydrating ketone dewaxing solvent recovered by evaporation and steam stripping comprising recovering a portion of said solvent from a wax slurry as vapor from an evaporation zone, condensing wet solvent recovered from said steam stripping and forming two immiscible liquid layers therefrom, a water-rich liquid layer and a solvent-rich liquid layer, passing said solvent-rich liquid to a dehydrating zone wherein said solvent is dehydrated and passing said water-rich liquid layer to a deketonizing zone to remove solvent from the water, wherein the improvement comprises passing said solvent vapor from said evaporation zone directly to said dehydrating zone thereby operating said dehydrating zone without reboiling means. The water removed from the deketonizer is essentially solvent free and may be sent directly to sewerage and the dehydrated ketone solvent drawn off the bottom of the dehydrator is low enough in water content to be recycled back into the dewaxing process. If the bulk of the solvent is removed from the wax in more than one stage of evaporation, then vapor from the first stage may be passed directly to the dehydrator while the overheads from the other stage or stages may be sent to other solvent recovery means.

In a particularly preferred embodiment of a ketone dewaxing solvent recovery process employing the improvement of this invention, solvent-containing dewaxed oil and a wax slurry are each concurrently but separately and sequentially passed through low and high pressure flash evaporation zones wherein the bulk of the dewaxing solvent is removed therefrom and then passed to steam stripping zones wherein the remainder of the solvent is removed. The overheads from the steam stripping zones are condensed and passed to a decanting zone or drum to form two immiscible liquid layers or phases, a water-rich bottom layer and a solvent-rich upper layer. The water-rich layer is passed to a deketonizing or steam stripping zone wherein the solvent is removed from the water-rich liquid resulting in relatively solvent-free water being removed from the bottom of the deketonizing zone and sent to a sewer, with the solvent-containing overheads from the deketonizing zone being condensed and passed back to the decanting zone. The solvent-rich upper layer from the decanting zone is passed to the dehydrating or distillation zone wherein it acts as reflux. Essentially water-free solvent is removed as bottoms from the deketonizing zone. The improvement comprises passing all of the vapor overheads from the wax low pressure flash zone directly to the bottom of the dehydrating zone or tower, thereby eliminating the need for a reboiler on the dehydrating tower. Heretofore, the vapor overheads from the wax low pressure flash zone were used to preheat the wax slurry entering same, resulting in condensation of the low pressure overheads to the liquid state which was then fed to a dehydrator, the dehydrator having associated therewith a reboiler to provide heat needed for the operation thereof. By passing the wax low pressure flash zone overheads directly to the bottom of the dehydrator, enough heat is supplied thereto to eliminate the need for the reboiler. If desired, the heat needed for preheating the wax slurry entering the low pressure flash zone may readily be obtained by passing the combined stripper, deketonizer and dehydrator overhead vapors through heat exchange to preheat said wax slurry. This effects a saving of the heat previously supplied to the dehydrator reboiler and also saves at least a part of the cooling load previously required for condensing the stripper, dehydrator and deketonizer overheads.

Evaporation or flash evaporation as used herein is not necessarily limited to a simple flash evaporation zone or tower, but may also include a rectification zone. That is, both the low and high pressure flashes may occur in flash towers containing a rectification zone provided with reflux. Also, by high pressure is meant pressure equal to or exceeding about 20 psig, while low pressure refers to less than about 10 psig. The pressure levels are selected to most efficiently utilize the heat of condensation of the high pressure overhead stream to vaporize part of the solvent at low pressure by indirect heat exchange in a double-effect evaporation system. It is within the scope of this invention to use a single flash evaporation stage rather than a two stage system for solvent recovery. However, the use of two stages is preferable, because the overhead from the first of two successive flashes is a more favorable feed stream to the dehydrator since it contains a higher concentration of water.

The decanting zone comprises a decanting drum wherein two immiscible liquid layers coexist in equilibrium: a ketone-rich layer containing less than about 15 mole % water which is the lighter layer and a water-rich liquid layer containing less than about 7 mole % of ketone. The upper ketone-rich liquid is continuously drawn off and passed to the dehydrator, which may be a simple distillation column, wherein most of the water is removed from the ketone with the overhead from the dehydrator, comprising water vapor but with ketone solvent content about one-third less than that of the ketone-rich phase in the decanting drum. The lower layer or water-rich liquid in the decanting drum is continuously withdrawn and passed to a deketonizer which may be a steam stripper or distillation column containing packing or trays wherein the steam serves to strip the ketone from the water, with essentially ketone-free water being removed rom the bottom thereof and passed to a sewer while the overhead vapor comprising about equal mole percentages of ketone and water is condensed and recycled back to the decanting drum.

It will be immediately obvious to those skilled in the art that the proper control of process parameters such as temperature, pressure and solvent composition are essential to the successful implementation of the instant invention. Also, the decanting step may be accomplished in a single settling drum with high and low draw offs for the two liquid phases or in a baffled drum with settling and draw off of the water phase in one compartment and overflow of the solvent phase to a second compartment.

Ketone dewaxing solvents useful in the operation of the instant invention are mixtures of MEK and MIBK and mixtures of MEK and toluene wherein the amount of MEK therein ranges from about 15 to 75 LV%.

DETAILED DESCRIPTION

Figure 1:
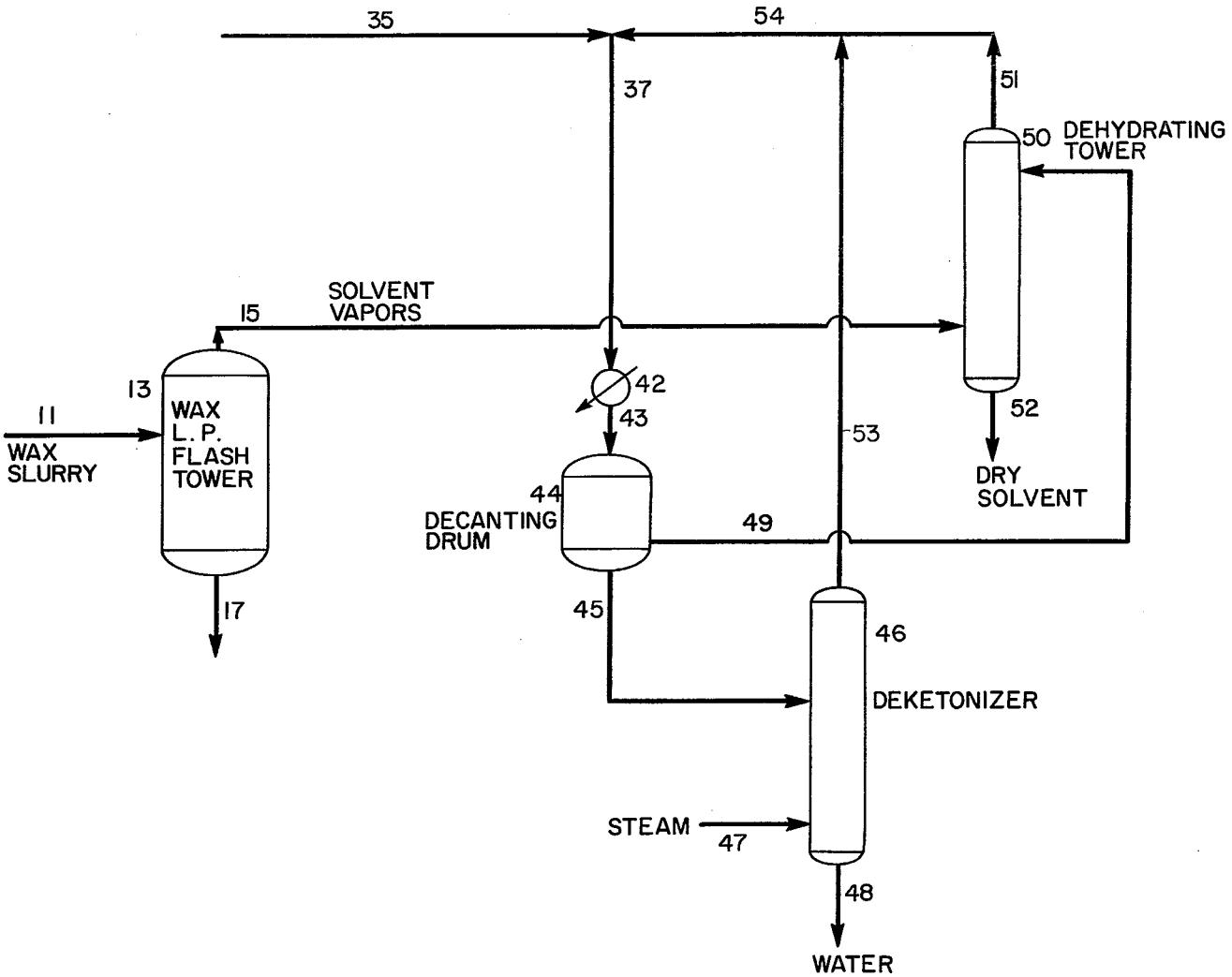
FIG. 1 is a flow diagram of a preferred embodiment of the instant invention.

Referring to FIG. 1, a solvent-containing wax slurry from wax filters (not shown) is fed into wax low pressure flash tower 13 via line 11 to remove about half of the dewaxing solvent therefrom which is drawn off as vapor via line 15 and passed directly to the bottom of dehydrating tower 50. The bottoms comprising wax and some solvent are removed from tower 13 via line 7. Dehydrating tower 50 is a typical distillation tower, usually containing about 16–18 sieve or valve trays. Solvent-rich liquid from decanting drum 44 is fed via line 49 into dehydrating tower 50 wherein it acts as reflux. The hot solvent vapors entering tower 50 via line 15 provide all of the heat necessary to operate the dehydrating tower. Relatively water-free or dehydrated solvent leaves the bottom of tower 50 via line 52 and is recycled back to the dewaxing process (not shown). Wet solvent overheads are withdrawn from tower 50 via line 51, combined with wet overheads coming from deketonizer 46 via line 53 and then additionally combined with wet overheads from dewaxed oil and wax steam strippers (not shown) coming from line 35. The combined overheads are then passed to condenser 42 via line 37, with the condensed liquid then passing to decanting drum 44 via line 43. Additionally, if desired, the combined overheads, in the vapor state may be withdrawn from line 37, passed to heat exchange (not shown) to preheat the wax slurry entering low pressure flash tower 13 via line 11 and then returned to line 37 and/or condenser 42 and thence to drum 44. Such preheating of the slurry via the combined overheads would restore the heat input to the wax recovery circuit formerly provided by condensing the solvent vapors in line 15. Water-rich liquid containing some solvent is withdrawn from decanting drum 44 via line 45 and passed to deketonizing tower 46. Deketonizing tower 46 may be a simple packed column type of distillation tower, and functions as a steam stripper to remove ketone solvent from the water-rich liquid. Steam enters deketonizer 46 via line 47 and relatively solvent-free water is withdrawn via line 48 and sent directly to sewerage. The wet, solvent-containing overhead vapors from deketonizer 46 are passed via line 53 to line 54 wherein they are combined with the overheads from dehydrator tower 50.

The temperature and pressure in low pressure flash tower 13 will generally range from about 200° to 230° F and 2 to 7 psig. Under these conditions about 45 to 55

LV% of the solvent in the wax slurry will be removed therefrom passing overhead as vapor directly from tower 13 to the bottom of dehydrator 50 via line 15. The pressure in dehydrator 50 and deketonizer 46 is generally about 2 psig. The temperature of the overheads from the dehydrator and deketonizer will range from about 175° to 190° F and 185° to 200° F, respectively. The temperature of the dry solvent removed from the bottom of dehydrator 50 via line 52 will generally range from about 180° to 210° F, depending on the MEK content thereof, while the temperature of the water leaving the bottom of deketonizer 46 will typically be about 220° F. The water content of the low pressure vapor stream fed to the dehydrator generally ranges from about 1 to 2 mole % (0.3 to 0.5 wt.%), but may run higher. The water content of the solvent-rich liquid phase fed from the decanter to the dehydrator as reflux is generally from about 15 to 20 mole % where the solvent is a mixture of MEK and MIBK and from about 5 to 15 mole % for an MEK/toluene solvent. The dehydrated solvent taken as bottoms from the dehydrator contains less than 0.8 mole % water (0.2 wt.%). Since the overheads from both the dehydrator and deketonizer are recycled and because the bottoms from the deketonizer contains no solvent, the dehydrated solvent stream (line 52) contains all of the solvent from both the stripper overheads (line 35) and from the wax low pressure flash stage (line 15). The quantity of solvent vapor feed passed to the dehydrator is adjusted for heat balance and to keep the water content of the dehydrated solvent drum to the desired level, generally under 0.3 wt.% for MEK/MIBK and under 0.2 wt.% for MEK/-toluene.

Figure 2:
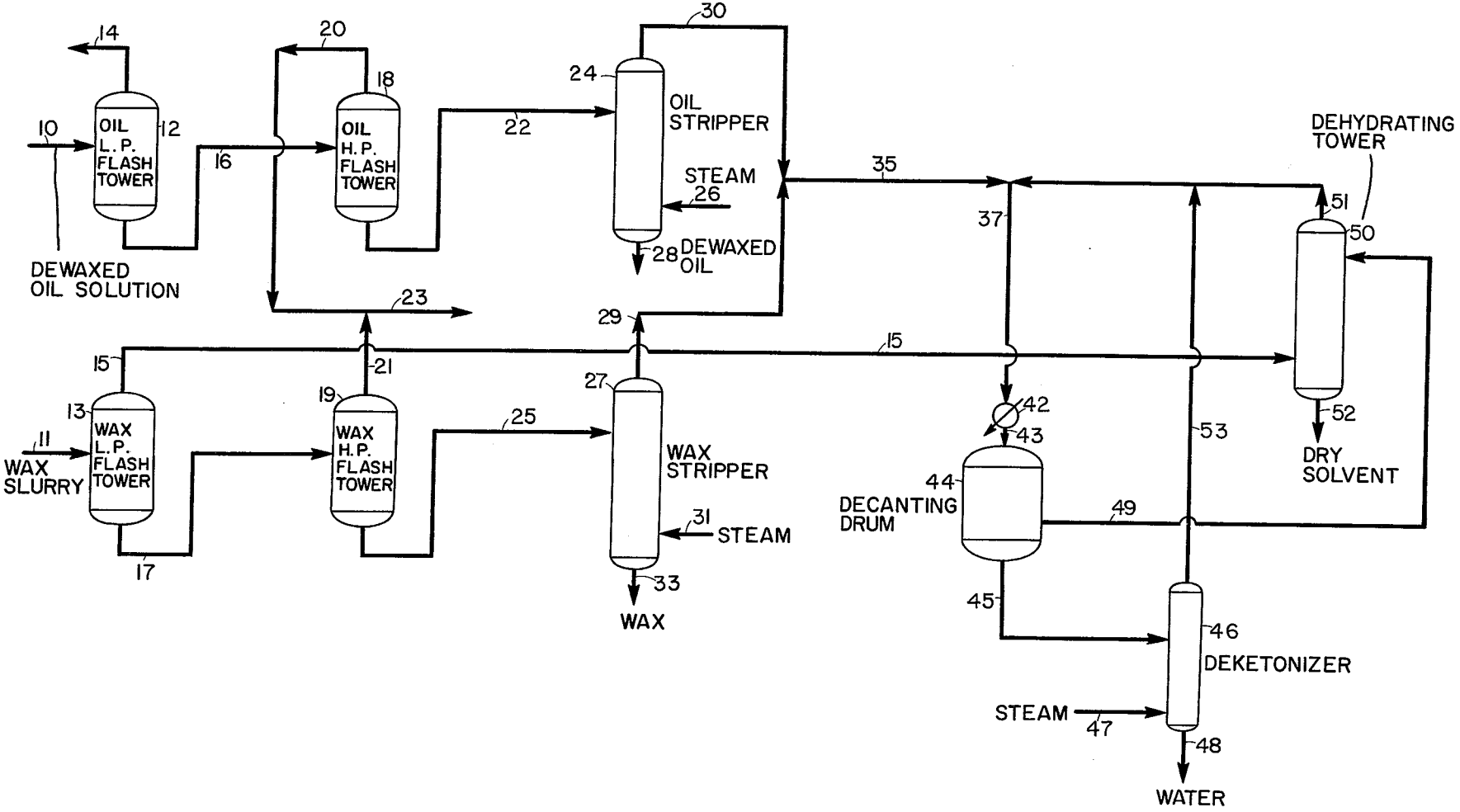
FIG. 2 is flow diagram of ketone dewaxing solvent recovery process employing the improvement of the instant invention.

FIG. 2 is a flow diagram of a preferred embodiment of a ketone dewaxing solvent recovery-dehydration process employing the improvement of the instant invention. Referring to FIG. 2, solent-containing dewaxed oil and a wax slurry are concurrently passed to low and high pressure flash evaporation towers via lines 10 and 11, respectively. Solvent-containing dewaxed oil is passed to low pressure tower 12 via line 10 wherein about half of the dewaxing solvent is removed therefrom as overhead via line 14 and recycled back to the dewaxing process, with the dewaxed oil product containing some solvent removed from the bottom thereof via line 16 and passed to high pressure flash tower 18 wherein most of the remaining solvent is removed as overhead via line 20, combined with the solvent overhead from wax high pressure flash tower 19 via lines 21 and recycled back to the dewaxing process via line 23. The dewaxed oil containing only minor quantities of solvent is removed as bottoms from tower 18 and passed to steam stripper 24 via line 22 wherein it is contacted with steam entering the tower via line 26 resulting in wet solvent overheads being removed from the tower via line 30 and substantially solvent-free dewaxed oil being removed therefrom via line 28. Similarly, the solvent-containing wax slurry enters low pressure flash tower 13 via line 11 wherein most of the solvent vapors are removed therefrom and withdrawn as overheads via line 15 and passed directly to dehydrator tower 50. The bottoms from tower 13 comprising wax and some solvent are then passed to high pressure flash tower 19 via line 17 wherein substantially most of the remaining solvent is removed therefrom via line 21 and combined with the overheads from tower 18. The bottoms from tower 19 comprising wax with minor quantities of solvent is passed to steam stripper 27 via line 25 wherein it is contacted with steam entering the tower via line 31 resulting in wet solvent overheads being withdrawn via line 29 and substantially solvent-free wax passing as bottoms via line 33 to further processing. The wet solvent vapor overheads from strippers 24 and 27 are combined and passed via line 35 to line 37 wherein they are combined with wet overheads from dehydrator 50 and deketonizer 46 and then passed to condenser 42 via line 37. Additionally, if desired, these wet vapors may be passed through a partial condenser wherein same may be used to provide heat to the wax slurry preheat train (not shown) and then returned to condenser 42. The vapors are condensed in condenser 42 and passed to decanting drum 44 via line 43. In decanting drum 44 two liquid layers are formed, a lighter, solvent-rich layer containing some water which is removed therefrom via line 49 and passed to dehydrator tower 50 wherein it acts as reflux and a heavier, water-rich layer containing some solvent which is withdrawn from drum 44 via line 45 and fed to deketonizer 46 wherein it is contacted with steam entering the deketonizer via line 47 with subtantially solvent-free water being withdrawn therefrom via line 48 and passed directly to sewerage.

PREFERRED EMBODIMENT

This invention will be more apparent from the preferred embodiment which is illustrated by the following example which is a computer simulation of the instant invention.

This example uses a 70/30 LV% mixture of MEK and MIBK as the ketone dewaxing solvent to be recovered.

Figure 3:
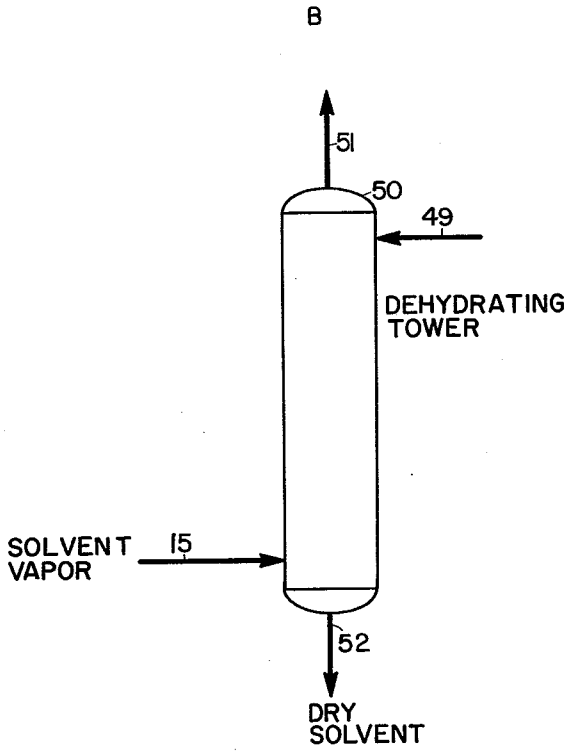
FIG. 3 is a flow diagram illustrating the difference in operation of a dehydration tower employing the improvement of the instant invention as compared to a dehydration tower requiring a reboiler associated therewith taught by the prior art.
Figure 3:
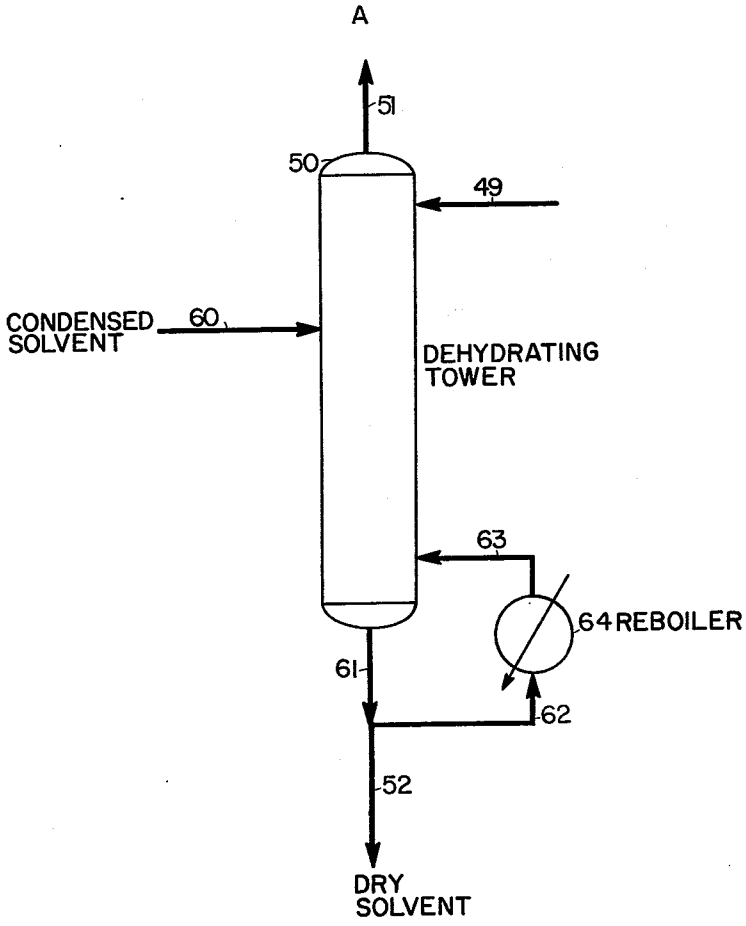

Referring to FIG. 3(*b*), 57,445 pounds per hour of solvent vapor at 228° F along with 434 pounds per hour of water or 0.75 wt.% water are passed to the bottom of dehydrating tower 50 via line 15 from wax low pressure flash tower 13 (not shown). At the same time, liquid at a temperature of 130° F and comprising 69,810 pounds per hour of solvent along with 5.1 wt.% of water or 3,775 pounds per hour of water is passed into the top of tower 50 via line 49 from decanting drum 44 (not shown). This liquid stream acts as reflux in tower 50. This results in 78,341 pounds per hour of liquid solvent at a temperature of 207° F carrying 0.2 wt.% water (156 pounds per hour of water) being withdrawn from the bottom of tower 50 via line 52 which is then recycled back into the dewaxing process. At the same time, 48,914 pounds per hour of solvent vapors plus 4,053 pounds per hour of water are removed as overheads from tower 50 via line 51 and then combined with the vapor overheads from the steam strippers and the deketonizer (not shown).

FIG. 3(*a*) represents the operation of the dehydrator taught by the prior art in that a reboiler is used to provide the heat necessary to operate dehydrator tower 50. In this operation, liquid at 130° F comprising 41,121 pounds per hour of solvent and 5.1 wt.% or 2,220 pounds per hour of water is passed into tower 50 via line 49. At the same time, the vapor overheads from wax low pressure flash tower 13 (not shown) are condensed to the liquid state and passed into tower 50 via line 60, comprising liquid at 185° F having the following composition; 54,445 pounds per hour of solvent and 434 pounds per hour of water or 0.75 wt.% water. Solvent removed from the bottom of the tower via line 61 is in liquid state at a temperature of 207° F and is essentially water-free. 45,065 pounds per hour of liquid solvent are taken off from line 61 and passed into reboiler 64 via line 62 wherein same is converted to vapor at 207° F and then fed back into tower 50 via line 63. This results in a net liquid/solvent product being withdrawn from line 52 as 78,341 pounds per hour of solvent at a temperature of 207° F and containing essentially no water. Vapor overheads from tower 50 comprise 20,225 pounds per hour of solvent and 2,654 pounds per hour of water at a temperature of 172° F.

The operation of the instant invention is thus seen to result in substantial energy savings by eliminating the need for the reboiler on the dehydrating tower and yielding a liquid recovered ketone dewaxing solvent low enough in water to be recycled back into the dewaxing process.

What is claimed is:

1. An improved process for dehydrating ketone dewaxing solvent recovered by evaporation and steam stripping comprising recovering a portion of ketone dewaxing solvent from a wax slurry as vapor from a wax slurry evaporation zone, condensing wet solvent recovered from said steam stripping and forming two immiscible liquid layers therefrom, a water-rich liquid layer and a solvent-rich liquid layer, passing said solvent-rich liquid to a dehydrating zone wherein said solvent in said solvent-rich liquid is dehydrated and passing said water-rich liquid layer to a deketonizing zone to remove solvent from the water, wherein the improvement comprises passing said ketone dewaxing solvent vapor from said wax slurry evaporation zone directly to said dehydrating zone thereby operating said dehydrating zone without reboiling means.

2. The process of claim 1 wherein said solvent is selected from the group consisting of mixtures of (a) MEK and MIBK and (b) MEK and toluene.

3. The process of claim 2 wherein said deketonizing zone is a steam stripping zone.

4. The process of claim 3 wherein said dehydrating zone is a distillation zone not having associated therewith any reboiling means.

5. The process of claim 4 wherein said dehydrated solvent contains no more than about 0.3 wt.% water.

6. The process of claim 5 wherein said solvent-rich liquid layer is passed to said dehydrating zone as reflux.

7. The process of claim 6 wherein said immiscible liquid layers are formed and separated in a decanting zone.

8. An improved process for dehydrating ketone dewaxing solvent wherein dewaxed oil and a wax slurry containing said solvent are each concurrently, but separately and sequentially passed through low and high pressure flash evaporation zones and then to steam stripping zones comprising condensing wet solvent vapor from said steam stripping and forming two immiscible liquid layers therefrom, a water-rich liquid layer and a solvent-rich liquid layer, passing said water-rich liquid to a deketonizing zone to remove solvent therefrom, passing said solvent-rich liquid to a dehydrating zone as reflux wherein water is removed from said solvent and wherein said dehydrating zone is not equipped with reboiling means, recovering vapor overheads from said deketonizing and dehydrating zones and combining them with said vapor from said steam stripping prior to condensing same, wherein the improvement comprises recovering solvent vapor from said wax low pressure flash zone and passing same directly to a lower portion of said dehydration zone, thereby enabling said dehydration zone to operate without reboiling means.

9. The process of claim 8 wherein said deketonizing and dehydrating zones comprise steam stripping and distillation zones, respectively.

10. The process of claim 9 wherein said dehydrated solvent contains no more than about 0.3 wt.% water.

11. The process of claim 10 wherein the amount of solvent removed from the water in said deketonizing zone is such that said deketonized water is essentially solvent-free.

12. The process of claim 10 wherein said two immiscible liquid layers are formed in a decanting zone.

13. The process of claim 8 wherein said combined vapor overheads are used to preheat said wax slurry before said slurry is passed to said low pressure flash zone, thereby at least partially condensing said vapor overheads prior to completely condensing same and forming two immiscible liquid layers therefrom.

14. The process of claim 12 wherein said solvent is selected from the group consisting of mixtures of (a) MEK and MIBK and (b) MEK and toluene.

15. The process of claim 14 wherein the temperature and pressure in said wax slurry low pressure flash evaporation zones ranges from about 200° to 230° F and 2 to 7 psig, respectively.

16. The process of claim 15 wherein about 45 to 55 LV% of the solvent in said wax slurry is removed as vapor overhead from said low pressure flash zone and passed directly to the bottom of said dehydrating zone.

* * * * *